US006135623A

United States Patent [19]

Lin

[11] Patent Number: 6,135,623

[45] **Date of Patent: *Oct. 24, 2000**

[54] INSERTIBLE POST LAMP

[76] Inventor: Mei-Lu Lin, 56, Min Sheng Street, Feng-Yuan City, Taichung 42041, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 09/062,181

[22] Filed: Apr. 16, 1998

[51] Int. Cl.[7] ..... F21V 17/06

[52] U.S. Cl. ..... 362/431; 362/353; 362/360; 362/437

[58] Field of Search ..... 362/152, 153.1, 362/226, 249, 353, 360, 431, 437, 439, 443, 448; 439/414, 419

[56] References Cited

U.S. PATENT DOCUMENTS 3,866,034 2/1975 Russo ..... 362/152
5,036,447 7/1991 Taylor ..... 362/431
5,274,537 12/1993 Altman ..... 362/353
5,280,417 1/1994 Hall et al. ..... 362/226
5,398,180 3/1995 Lee ..... 362/431

*Primary Examiner*—Alan Cariaso

[57] ABSTRACT

A post lamp insertible into a lawn or ground in a garden or backyard is provided. The post lamp includes a taper ended post having a radial slot of roughly W-shaped section in the top and receiving spaces in opposite outer periphery for disposing and receiving a pair wires therein. A receptacle engageable with the post and retained by a retaining ring includes a pair of ring and tip plates both of which have tip points at lower end piercing into the wires. A multistoried pileus shade covers on the lamp for providing pleasant air in a garden party. The disclosure is characterized in a vertical coupling of the receptacle with the post so as to obviate the wires to be displaced or twisted to cause an electric shock or poor conductivity.

1 Claim, 6 Drawing Sheets

INSERTIBLE POST LAMP

BACKGROUND OF THE INVENTION

The present invention relates to garden lamps and more particularly to an insertible post lamp which is adapted for use in a garden party for providing decorative effect to the party.

Typical post lamps vary in types. It is spacedly planted in a garden in skillful arrangement. Therefore, it is not only for lighting up a partial area of the garden but also provides a beautiful scene at night. To provide an additional pleasure in a garden party, the insertible post lamps are adapted to temporarily plant into the lawn of a garden or backyard. The post lamp each has a small receptacle on the top for receiving a Christmas light and a reinforcement tapered lower end for inserting into the lawn. The Christmas lights are connected in series by a pair of wires which connect to an electric power source, so that a series of spaced post lamps are illuminated when the switch is closed. The receptacle is removable from the top of the post lamp and has a pair of copper contacts each of which includes a tip point protruded from the bottom which enables piercing into the wires so as to conduct the electricity from the wires to the light. To connect the receptacle with the post, a pair of L-shaped grooves are symmetrically formed in the inner periphery of the receptacle and made in registry with a pair of protrusions symmetrically formed on the outer periphery of the post. Therefore, the receptacle must be rotated a certain degree prior to becoming stable. This arrangement has a disadvantage of that when the receptacle turns laterally after the tip points pierced into the wires, the tip points may twist or disconnect causing a poor connection between the wires and the light or otherwise an electric shock.

The present invention is presenting to obviate the aforementioned disadvantage and to provide the benefit of a safer use of the post lamp.

SUMMARY OF THE PRESENT INVENTION

The present invention has a main object of providing a structurally improved post lamp in which a vertical coupling device between the receptacle and the post is provided to obviate the wires from being twisted during the coupling of the receptacle to the post so as to obviate an electric shock or poor conductivity between the wires and the light.

Another object of the present invention is to provide an insertible post lamp in which a pileus shade is provided as an overlapping structure in order to add a more a decorative effect.

The present invention will become more fully understood by reference to the following detailed description thereof when read in conjunction with the attached drawings.

DETAILED DESCRIPTION OF THE PREFERRED EMBODIMENT

Figure 1:
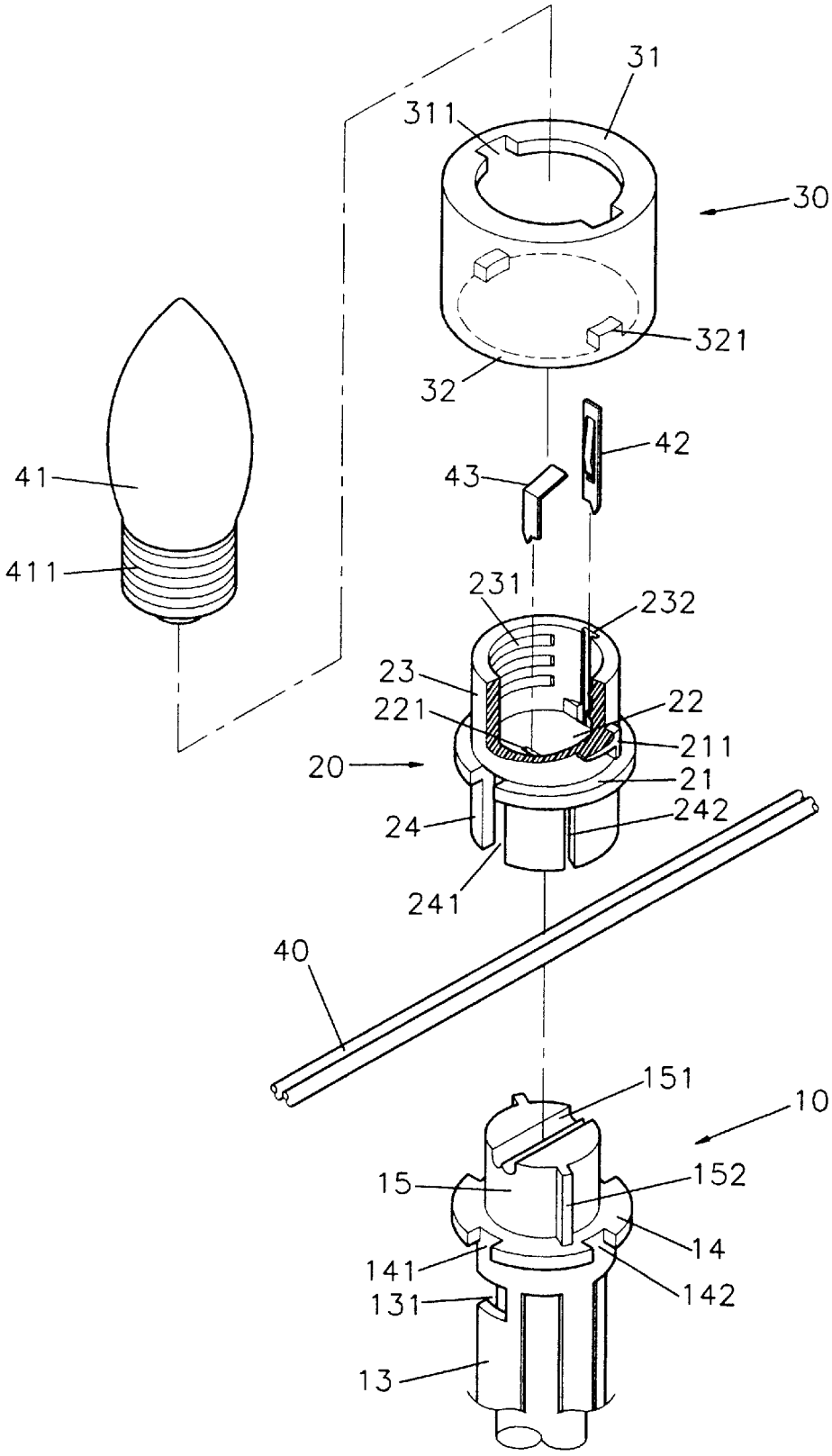
FIG. 1 is an exploded perspective view showing the preferred embodiment of the present invention.
Figure 2:
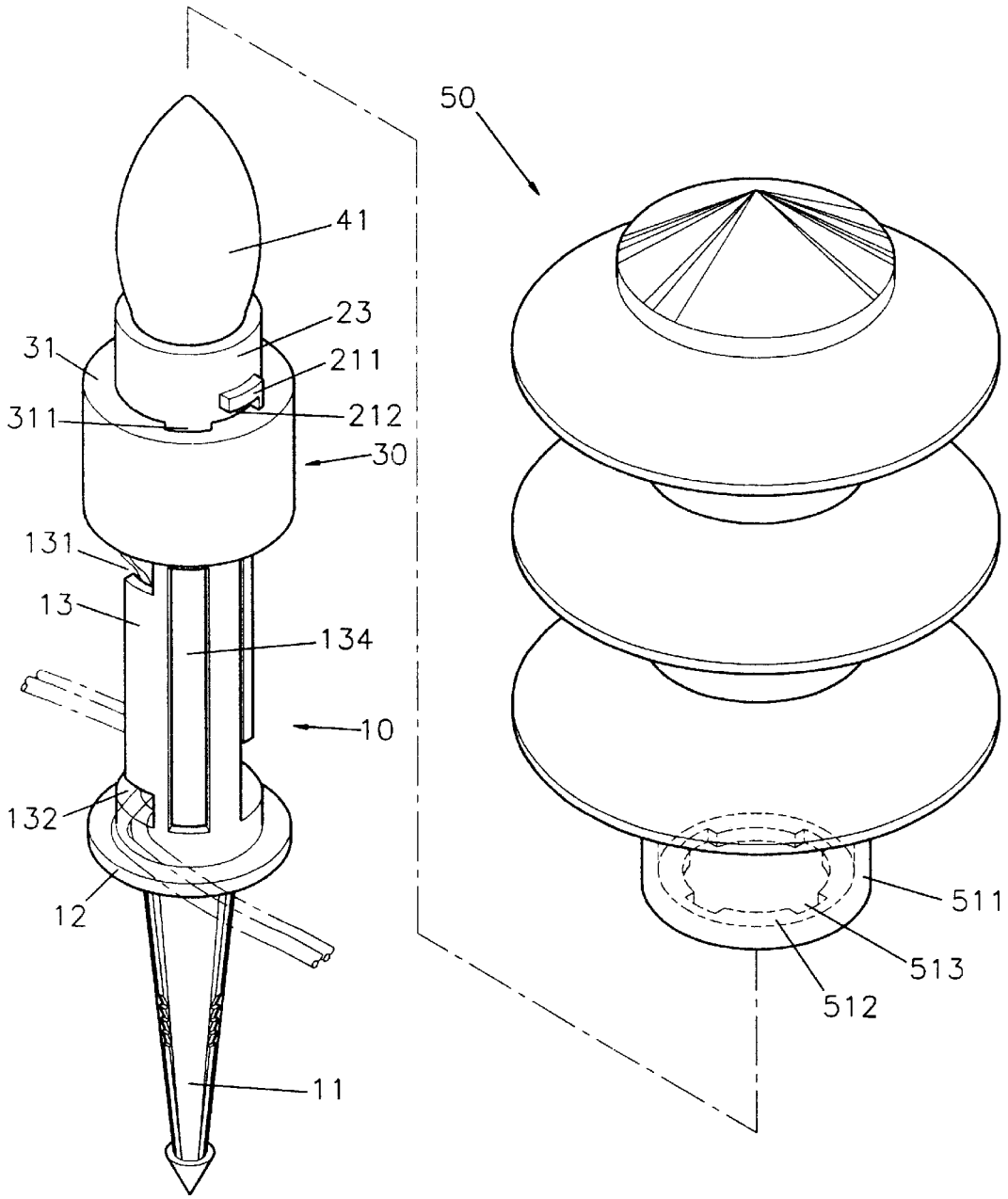
FIG. 2 is a perspective view of the assembly of FIG. 1 including an overlapping of the pileus shade.

With reference to FIGS. 1 and 2 of the drawings, the insertible post lamp of the present invention comprises generally a post 10, a receptacle 20, a retaining ring 30 and a pileus shade 50.

The post 10 includes a tapered lower end 11 which is reinforced with a plurality of spaced longitudinal ribs around outer periphery and is capable of inserting into the lawn or ground of a garden, a first annular flange 12 formed above the lower end 11 for limiting the further insertion of the lower end into the ground and for the stability of the post, a pair of peripheral extensions 13 extended symmetrically and alternately toward tangential direction from opposite periphery of the post 10 above the first annular flange 12 within which a pair of receiving spaces 133 are defined to receive the pair of wires 40 which get in from a first indentation 131 and out from a second indentation 132 of the extension 13, a plurality of longitudinal grooves 134 formed spaced apart around the outer periphery of the post 10 for the purposes of structural reinforcement and the use of less material, a second annular flange 14 formed above the extension 13 which includes a pair of passage slots 141 for the postage of the wires 40 and a pair of coupling slots 142 symmetrically formed around the outer peripheries thereof, and a cylindrical projection 15 centrally projected upward from the top of the post 10 above the second annular flange 14 including a radial slot 151 of roughly W-shaped section capable of anchoring the pair of wires 40 therein and a pair of longitudinal protrusions 152 symmetrically extended outward from opposite outer peripheries thereof.

The receptacle 20 includes a third annular flange 21 therearound at a middle part and a bottom 22 which defines the receptacle 20 into an upper and a lower tubular portions 23 and 24 within the upper tubular portion 23. There are threads 231 in an inner periphery of the upper tubular portion 23 for screwing the light 41 which has a threaded copper head 411 made in registry with the threads 231 and a longitudinal groove 232 formed in an inner periphery of the upper annular potion 23 and through the bottom 22 for engaging within a ring contact 42. An L-shaped tip contact 43 engages into a rectangular hole 221 of the bottom 22 opposite to the groove 232 both the ring and tip contacts have a tip point at lower ends exposed to outside of the bottom capable of piercing into the pair of wires respectively. A pair of protrusions 211 of L-shaped section extended outward from opposite outer peripheries of the tubular upper portion 23 abutting the top of the third flange 21. The tubular lower portion 24 includes a pair of longitudinal slots 241 in opposite peripheral walls made in registry with the pair of the passage slots 141 and a pair of narrow longitudinal slots 242 in opposite peripheral walls made in registry with the pair of longitudinal protrusions 152 of the cylindrical projection 15.

The retaining ring 30 includes an inwardly extended fourth annular flange 31, a pair of their indentations 311 in the opposite peripheries of the flange 31 which are made in registry with the L-shaped protrusions 211 and a fifth annular flange 32 extended inward from the lower edge thereof from the opposite peripheries of which a pair of retainers 321 are symmetrically projected upward. The retainers 321 are made in registry with the coupling slots 142 of the post 10.

The pileus shade 50 which is transparent and can be multistoried includes an annular extension 511 centrally extended from the underside, a sixth annular flange 512 extended inward from the lower edge of the extension 511 and a plurality of fourth indentations 513 symmetrically formed in the opposite peripheries of the flange 512. These fourth indentations 513 are also engageable with the L-shaped protrusion 211.

Figure 3:
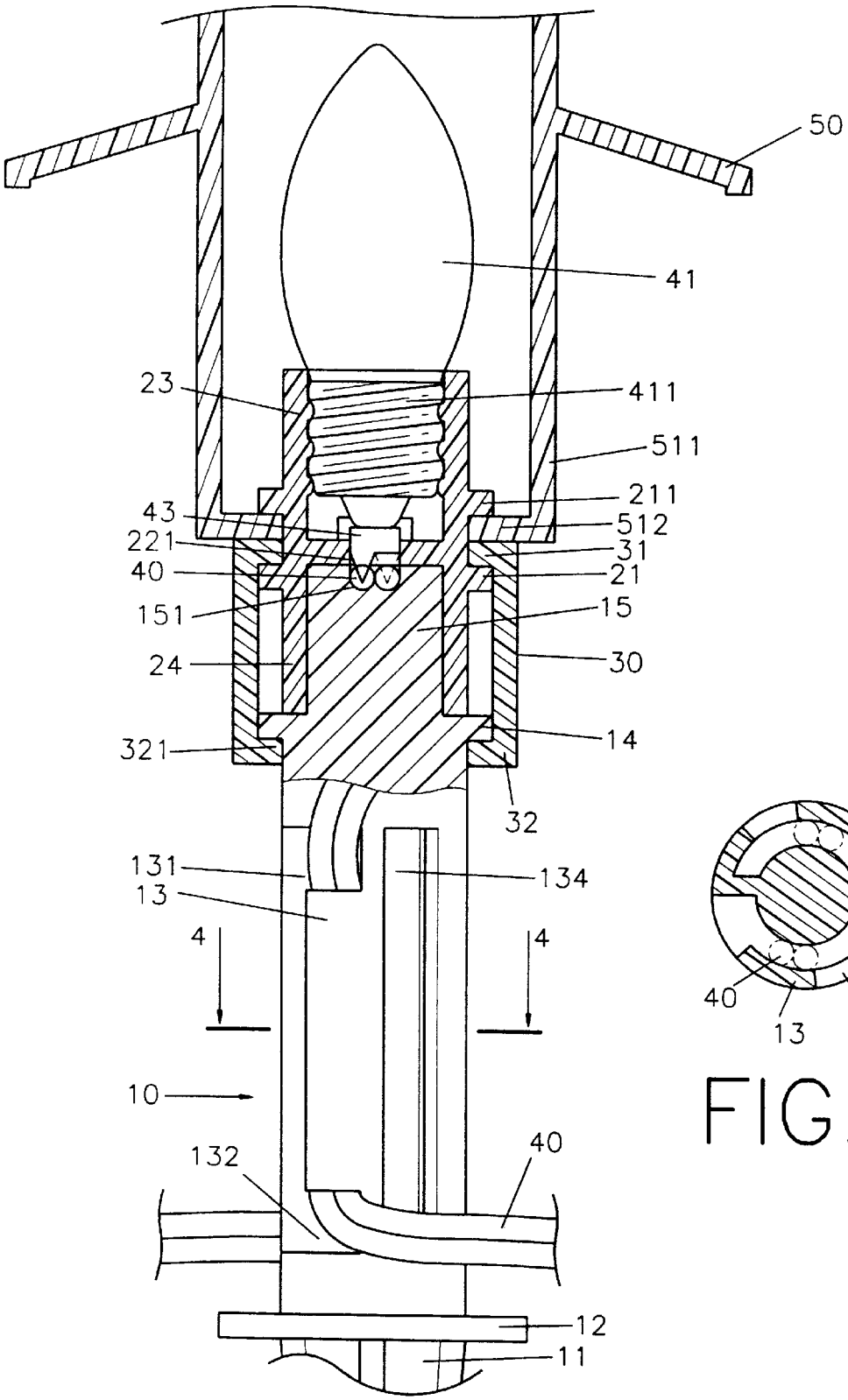
FIG. 3 is a perspective view with partially sectional view showing the assembly of FIG. 1.
Figure 4:
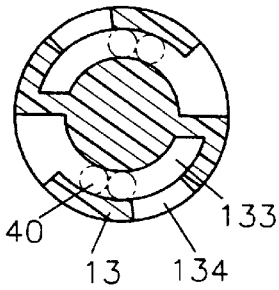
FIG. 4 is a section taken from line 4—4 of FIG. 3.
Figure 5:
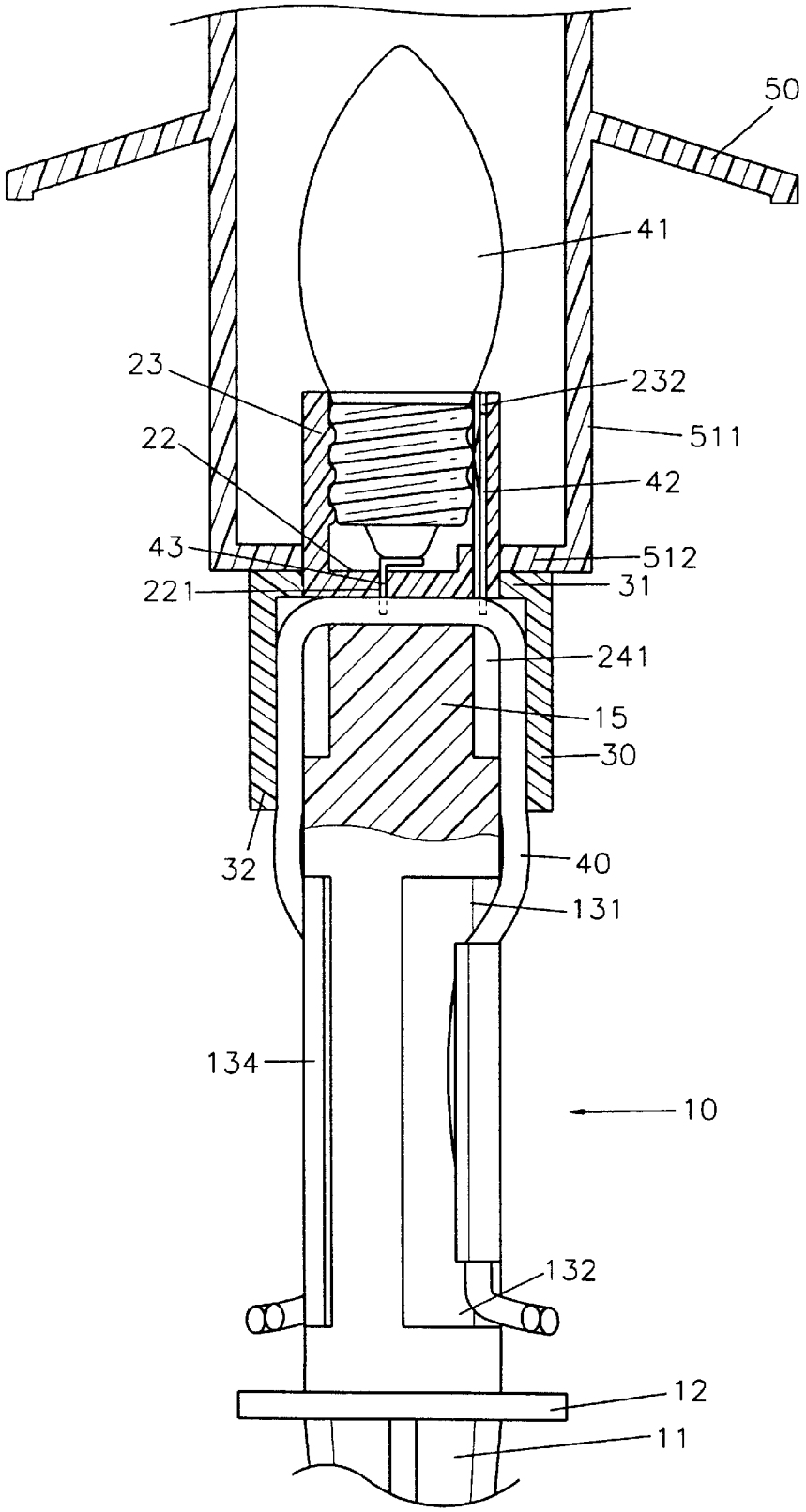
FIG. 5 is a perspective view with partially sectional view showing the assembly of FIG. 1 from a lateral side relative to FIG. 3.
Figure 6:
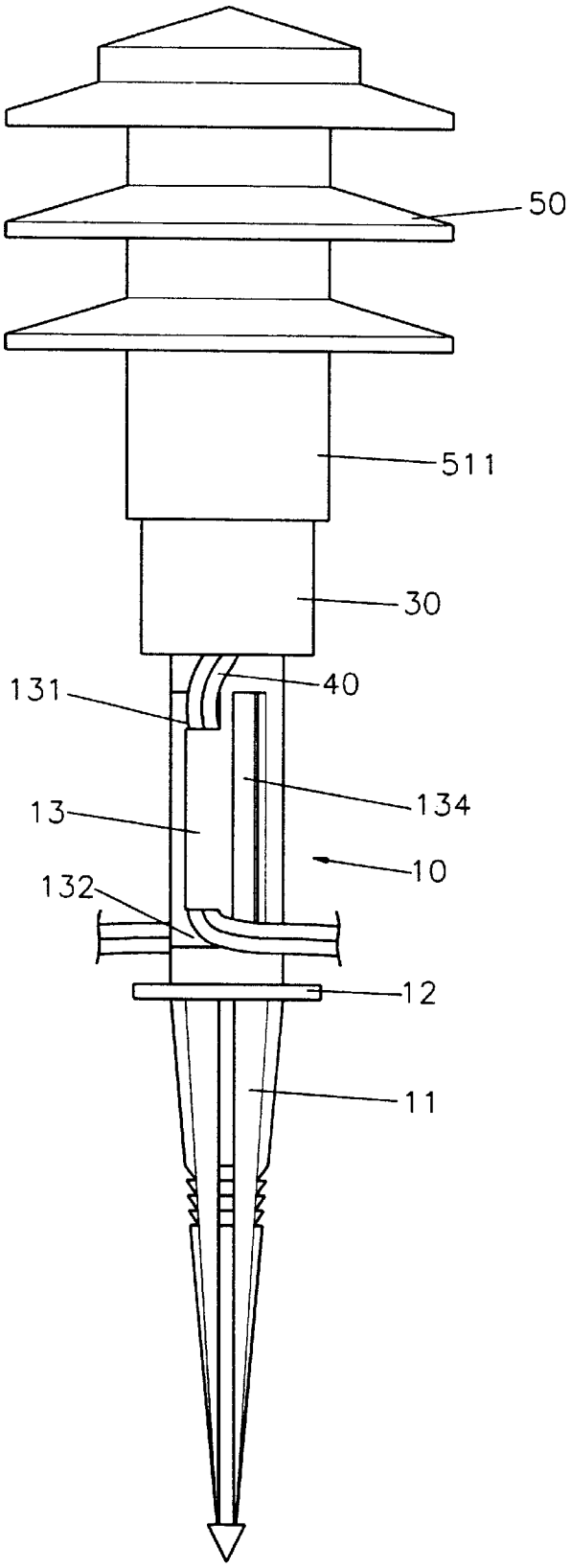
FIG. 6 is an elevational view showing the assembly of the post lamp of the present invention.
Figure 7:
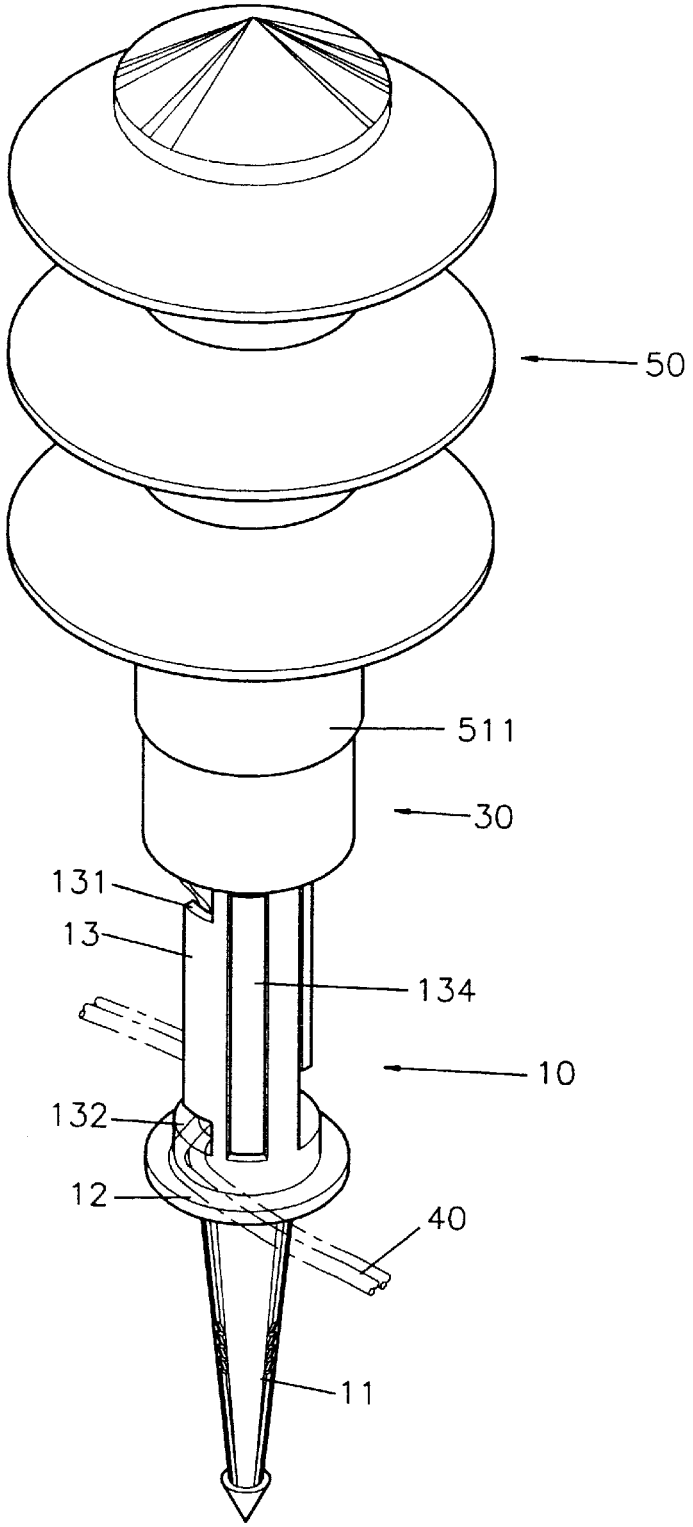
FIG. 7 is a persective view of FIG. 6.

Referring to FIGS. 3 to 7, when assembling or the application of the post lamp of the present invention, the post is uprightly inserted into the ground or the lawn of a garden at first with the first annular flange 12 stably stopped on the ground, then the pair of wires 40 are placed parallel into the radial slot 151, the two ends of the wires 40 are respectively engaged into the receiving spaces 133 behind the extensions 13 through the passage slots 141, the firs and second indentations 131 and 132 (as shown in FIGS. 4 to 6), and then the receptacle 20 is coupled with the cylindrical projections 15 of the post 10 by vertically pressing the receptacle 20 downward and with narrow longitudinal slots engaging with the longitudinal protrusions 152 of the cylindrical projection 15 so that the wires are respectively pierced by the tip points of the ring and tip contacts 42 and 43. When the switch of the wire is turned on, the light 41 will be illuminated. Because the receptacle 20 is engaged with the post 10 without rotation, the wires are never twisted and the tip points are stably inserted into the wires 40 without causing an electric shock or poor conductivity. Finally, the retaining ring 30 is sleeved on the receptacle 30 by pressing the retaining ring 30 downward and its retainers 321 and third indentations 311 are respectively passed through the coupling slots 142 of the post 10 and the L-shaped protrusions 211 of the receptacle 20. The retaining ring 30 is rotated counterclockwise a small angle so that the retainers 321 are retained by the second annular flange 14 of the post 10 and the annular flange 31 is positioned under the L-shaped protrusions 211. Therefore, the receptacle 20 is pressed more downward to provide an advantage that the tip point of the contacts 42 and 43 will be inserted more deeper into the wires 40 and the coupling of the receptacle 20 with the post 10 is made more secure. There is a receiving space 212 defined between each of the L-shaped protrusions 211 and the top of the flange 31 so that the space 212 is capable of retaining the pileus shade 50. The coupling of shade 50 with the lamp is made very simple. One may engage the fourth indentations 513 with the L-shaped protrusion 211 and press the shade 50 downward and then rotate it counterclockwise. The annular flange 512 of the shade 50 is retained within the spaces 212 between the L-shaped protrusions 211 and the annular flange 31 of the retaining ring 30, as shown in FIGS. 3 and 5. FIGS. 6 and 7 show a complete assembly of the post lamp of the present invention. However, the two ends of the pair of wires are extendible to adjacent post lamps so as to form a series of post lamps which are lighted alternately to provide a visual pleasure in a garden party.

Note that the description of the above embodiment should be construed as exemplary rather than as limitative of the present invention, with many variations and modifications being readily attainable by a person of average skill in the are without departing from the spirit or scope thereof as defined by the appended claims and their legal equivalents.

What is claimed is:

1. A post lamp capable of insertion into the ground in a garden party comprising:

a post including a tapered lower end reinforced with spaced longitudinal ribs around an outer periphery thereof, a first annular flange above the lower end for limiting the lower end from further insertion into the ground, a pair of peripheral extensions symmetrically extended toward a tangential direction from a periphery thereof above the first annular flange within which a pair of receiving spaces are defined to receive a pair of wires, a pair of first and second indentations at two ends of each of said extensions and accessible into said receiving spaces, a plurality of longitudinal grooves spacedly formed around the outer periphery of the past, a second annular formed above said extension including a pair of passage slots and a pair of coupling slots symmetrically and alternately formed spaced apart around the outer peripheries thereof, and a cylindrical projection centrally projected upward from above said post second annular flange having a radial slot of roughly W-shaped section across an upper surface for placing said pair of wires, and a pair of longitudinal protrusions symmetrically extended from opposite outer peripheries of said cylindrical projection thereof;

a receptacle engageable with the cylindrical projection of said post including a third annular flange therearound and a bottom to define said receptacle as upper and lower tubular parts, said upper tubular part having a threaded inner periphery for engaging with a Christmas light and a longitudinal groove in an inner periphery through the bottom for securing a ring contact plate therein, a L-shaped tip contact plate securing into a rectangular hole in the bottom opposite to said ring contact plate, said ring and tip contact plates each having a tip point at lower end exposed to outside from underside of said bottom capable of piercing into said pair of wires respectively, a pair of L-shaped protrusions symmetrically projected outward from opposite outer peripheries of the upper tubular part abutting said third annular flange; said lower tubular part including a pair of longitudinal slots formed on opposite peripheral walls made in registry with the passage slots of said post and a pair of narrow longitudinal slots in opposite peripheral walls apart to said longitudinal slots and made in registry with the longitudinal protrusions of the cylindrical projection of said post;

a retaining ring sleeved on said receptacle and engaged with said post for retaining said receptacle with said post and including a fourth annular flange extending inward from an upper rim of said retaining ring having a pair of their indentations in opposite peripheries thereof made in registry with the L-shaped protrusions of said receptacle and a fifth annular flange extending inward from a lower rim of said retaining ring having a pair of retainers symmetrically projected upward from opposite peripheries thereof and made in registry with the pair of the coupling slots of said post;

a transparent multi-stored pileus shade engageable with said receptacle and including an annular extension centrally extending from underside thereof, a sixth annular flange extending inward from lower rim thereof having a plurality of fourth indentations symmetrically formed in opposite peripheries thereof engageable with the L-shaped protrusions of said receptacle;

whereby said post lamp is lighted in series to provide visual pleasure in a garden party.

* * * * *